United States Patent [19]

Beacom et al.

[11] 4,427,736

[45] Jan. 24, 1984

[54] ANTI-STATIC DRYER FABRIC

[75] Inventors: Oliver J. Beacom, Ottawa; Hugh A. Moger, Kanata, both of Canada

[73] Assignee: JWI Ltd., Kanata, Canada

[21] Appl. No.: 335,409

[22] Filed: Dec. 29, 1981

[51] Int. Cl.[3] ..... B05D 5/12; D03D 25/00; D21F 7/12

[52] U.S. Cl. ..... 428/288; 34/116; 34/123; 118/77; 139/383 A; 162/358; 427/11; 427/393.1

[58] Field of Search ..... 427/11, 393.1; 118/77; 184/1 E, 16, 102; 139/383 A; 34/116, 123; 162/358, DIG. 1; 428/288, 290

[56] References Cited

U.S. PATENT DOCUMENTS 4,154,886 5/1979 Yamayaki et al. ..... 428/286

*Primary Examiner*—James C. Cannon

*Attorney, Agent, or Firm*—Swabey, Mitchell, Houle, Macoux & Sher

[57] ABSTRACT

This invention relates to a method of dissipating the static charge that is built up by a dryer fabric operating in the dryer section of a paper making machine, thereby preventing adhesion of the paper to the fabric when it is transferred from one fabric to another. More particularly the invention relates to the addition of an anti-static agent to the coating material which is applied to the dryer fabric. The invention also relates to a dryer fabric coated with a coating material which includes 0.2 to 10% by weight of an anti-static agent.

6 Claims, 1 Drawing Figure

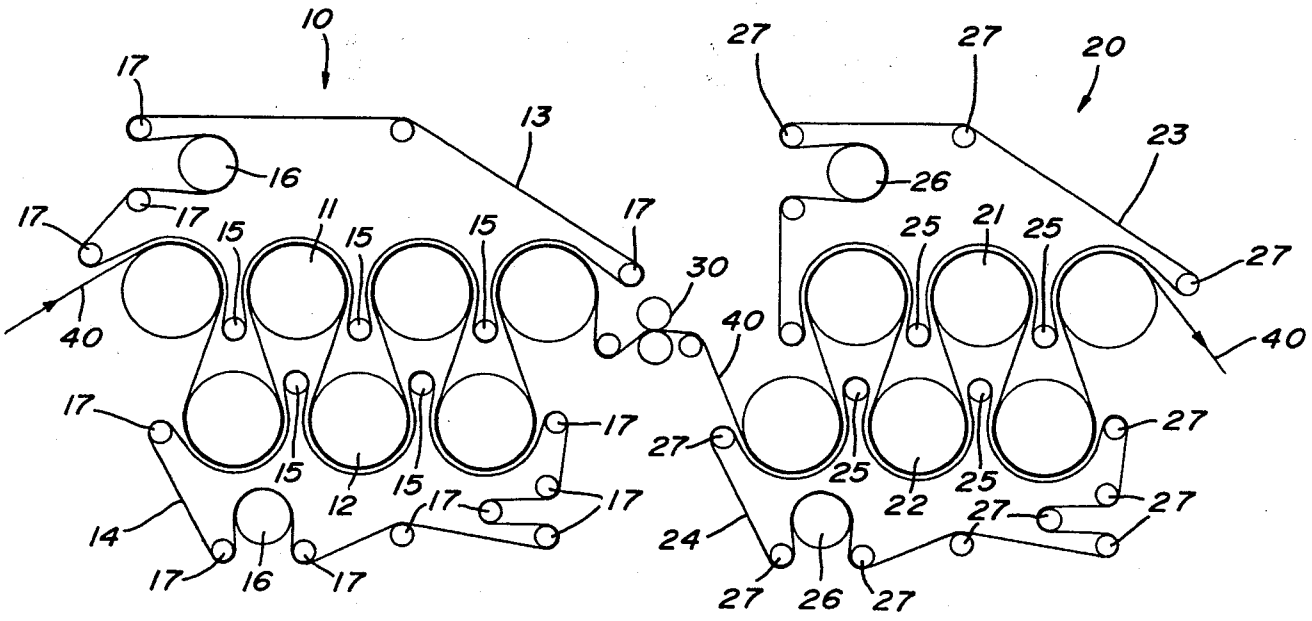
10
11
12
13
14
15
16
17
20
21
22
23
24
25
26
27
30
40

ANTI-STATIC DRYER FABRIC

BACKGROUND OF INVENTION (a) Field of the Invention

This invention relates to a method of dissipating the static charge that is built up by a dryer fabric operating in the dryer section of a paper making machine, thereby preventing adhesion of the paper to the fabric when it is transferred from one fabric to another. More particularly the invention relates to the addition of an anti-static agent to the coating material which is applied to the dryer fabric.

(b) Description of Prior Art

In a paper making machine, after the web of paper has been formed and partially dewatered in the forming and press sections, it is delivered to the dryer section where it passes, in serpentine fashion, over a number of heated rotating dryer cylinders and is held tightly against the cylinders by dryer fabrics. A conventional dryer fabric consists of an endless belt woven from either natural or synthetic yarns to form a relatively bulky fabric that will have good absorbent characteristics and high porosity. The yarns are woven closely together and sometimes in several plies to form a comparatively impermeable fabric. The fabric may have incorporated into it stuffer yarns of bulky mineral or organic fibres and is generally coated with a resin material to impart dimensional stability and resistance to degradation by hydrolysis and/or heat.

The function of a dryer fabric is to hold the paper web against the heated surfaces of the rotating dryer cylinders in order to promote more effective heat transfer to the web by partially eliminating a heat insulating layer of air which adheres to the surface of the cylinders. The fabric also serves to prevent the paper web from wrinkling.

Dryer fabrics run at speeds up to 3000 feet per minute and over metal rolls that are heated and dry with the result that, in spite of the moist environment due to water being driven off from the paper web, there is considerable build-up of static electricity in the system. This build-up is particularly evident in the dry end of the dryer section—that is in the last few sub-sections before the paper web is delivered to the stack of the machine.

There are two objectionable disadvantages caused by build-up of static electric charge on a dryer fabric. One is that when a machine is being started up and attempts are made to string the paper through the dryer by passing a tail of paper from one roll to another or from one subsection to another, as is common practice, the tail of paper tends to cling to the electrostatically charged fabric on or under which it is running and resists being lifted off for transfer. This results in loss of paper stock and time during start-up procedures. This disadvantage is particularly evident after a break in the paper or an extended temporary stoppage of the machine when the dryer cylinders remain hot and the fabrics have become dry. Another disadvantage is that personnel attending the machine can be subjected to startling and sometimes painful shocks.

Attempts have been made previously to dissipate static electric charge from dryer fabrics and these have included the addition of metallic strands in the yarns that are woven or the addition of finely divided carbon particles embedded in polyester yarn. Neither of these methods has proven successful. Attempts have also been made to drain away the static charge by various means of grounding components of the dryer equipment. This has not been entirely successful either because the static charge builds up between grounding elements and still is hazardous to personnel.

SUMMARY OF INVENTION

It is an object of the present invention to provide a paper machine dryer fabric which has the property of dissipating an electrostatic charge. The dryer fabric of the invention is any one which may be coated with a thermosetting resin and cured by heating. The cured coating serves to consolidate any multifilament yarns of the fabric into monofilament-like yarns. It also serves to glue the yarns together at the warp and weft crossovers to impart dimensional stability and to protect the fabric against degradation by heat and moisture.

In accordance with the invention the coating resin is rendered capable of dissipating an electrostatic charge by the addition of a known, compatible anti-static agent before the resin is applied to the fabric and cured.

In the preferred embodiment of the invention the coating resin containing the anti-static agent is applied to the fabric by passing the fabric in contact with an application roll which is partially immersed in a solution of the coating material. After passing over the application roll the fabric is then passed over a vacuum slot where excess coating solution is drawn off and the fabric is then subjected to a temperature of about 182° C. to cure the residual coating material on the fabric. Typically the coating material will amount to from 10 to 25% of the total weight of the cured fabric.

The coating solution into which the anti-static agent is added may be any of the known thermosetting resins. The preferred type is a thermosetting water soluble acrylic latex having a solids content in the range of 25 to 50%.

The preferred anti-static agent is one that is known as NOPCOSTAT PE47 (supplied by Diamond Shamrock Corporation). This agent is a slightly viscous liquid and it is simply added to the coating solution wherein it quickly becomes completely dispersed. Laboratory tests have shown that other anti-static agents, that are reasonably compatible, mixed in the coating material before it is applied to the fabric and cured, will also prevent a build-up of static charge on the dryer fabric.

Further tests have also indicated that all-monofilament dryer fabrics that are not usually coated with acrylic latex solution may be rendered free of electrostatic charge build-up when some of the stuffer or other weft yarns have been coated with resin material containing a small percentage by weight of anti-static agent before they are woven into the fabric.

According to a broad aspect of the invention there is provided a paper machine dryer fabric that is resistant to build-up of electrostatic charge, said fabric being coated with a thermosetting, water soluble acrylic latex solution and characterized in that said coating material has been treated by the addition of an anti-static agent in the amount of from 0.2 to 10% by weight. In a preferred embodiment of the invention the coating material would be treated by the addition of from 0.5 to 2% by weight of the anti-static agent.

BRIEF DESCRIPTION OF DRAWING

The single drawing illustrates a typical dryer section in a paper making apparatus.

DESCRIPTION OF PREFERRED EMBODIMENTS

A portion of a typical dryer section in which a fabric of the invention would be used is schematically illustrated in the accompanying drawing, FIG. 1, in which a sub-section 10 and a second sub-section 20 are shown. Top tier dryer cylinders of each sub-section are generally indicated at 11 and 21 respectively and bottom tier dryer cylinders of each sub-section are generally indicated at 12 and 22 respectively. A breaker stack which may be located between the sub-sections is shown at 30. The paper web 40 passes in serpentine fashion through the sub-section 10, through breaker stack 30 and then in serpentine fashion through sub-section 20. Endless top dryer fabrics 13 and 23 hold the paper web tightly against upper cylinders 11 and 21 of sub-sections 10 and 20 respectively and endless bottom fabrics 14 and 24 hold the paper web tightly against lower cylinders 12 and 22 of the sub-sections respectively. The fabrics are guided around the peripheries of the dryer cylinders by felt rolls 15 and 25 and around top and bottom heated dryer rolls indicated at 16 and 26 by guide rolls 17 and 27.

As herein previously disclosed, when the dryer fabrics carry an electrostatic charge which causes the paper to cling to the fabric, considerable difficulty is encountered when guiding a start-up tail of the paper through the dryer sub-sections since the tail persists in clinging to the fabric and following it around a felt roll and onto the next dryer roll in the same tier rather than separating from an upper fabric, for example, and passing down between a lower fabric and a lower tier dryer cylinder. The same difficulty is experienced when attempting to pass the tail from one sub-section to the next sub-section through a breaker stack.

Since there are many such transfers of the paper tail off fabrics in a typical dryer section as can be seen and appreciated from the drawing, it will be apparent that a great amount of time can be saved and frustration avoided by using the fabrics of the invention which have been treated in the manner described.

EXAMPLE

The following example is given to illustrate the invention but nothing in the example should be interpreted as limiting the scope and spirit of the invention.

A dryer fabric having nylon-polyester combination multifilament warp and monofilament polyester weft was coated with acrylic latex solution into which NOPCOSTAT PE47 has been mixed in the amount of 1% by weight. Excess latex was vacuumed off and the residual coating on the fabric was cured at a temperature of 182° C. The amount of coating material on the fabric was 12.2% of the total weight of fabric.

This dryer fabric was installed on a paper machine and was found to completely eliminate the difficulty in passing the tail of paper through the dryer section in machine start-ups. This problem had been a persistent cause of lost time with other dryer fabrics that had not been treated with anti-static agents according to this invention.

We claim:

1. A paper machine dryer fabric resistant to build-up of electrostatic charge, said fabric having on the exterior surfaces thereof a thermoset coating formed from a water-soluble arcylic latex modified by the addition of 0.2 to 10% by weight of an anti-static agent.

2. A fabric as defined in claim 1 wherein said coating material results from the addition of from 0.5 to 2% by weight of the anti-static agent.

3. A fabric as defined in claim 2 wherein the coating material results from the addition of an anti-static agent in the amount of 1% by weight.

4. A method of preparing a paper machine dryer fabric resistant to build-up of electrostatic charge which comprises coating the fabric with a water soluble acrylic latex modified by the addition of 0.2 to 10% by weight of an anit-static agent, and curing the coating to a thermoset state.

5. A method as defined in claim 4 wherein the percent by weight of said anti-static agent is 0.5 to 2%.

6. A method as defined in claim 5 wherein the percent by weight of said anti-static agent is 1%.

* * * * *